United States Patent [19]

Deimel et al.

[11] Patent Number: 4,489,457

[45] Date of Patent: Dec. 25, 1984

[54] HEIGHT ADJUSTMENT MEANS FOR A CYLINDRICAL BRUSH IN A CARPET SWEEPER

[75] Inventors: Helmut Deimel; Rolf G. Schülein, both of Singhofen, Fed. Rep. of Germany

[73] Assignee: ITT Industries, Inc., New York, N.Y.

[21] Appl. No.: 555,914

[22] Filed: Nov. 29, 1983

[30] Foreign Application Priority Data

Mar. 21, 1983 [EP] European Pat. Off. ..... 83102762.8

[51] Int. Cl.[3] ..... A47L 11/33

[52] U.S. Cl. ..... 15/41 R

[58] Field of Search ..... 15/41–48

[56] References Cited

U.S. PATENT DOCUMENTS 3,623,176 11/1971 Leifheit et al. ..... 15/42

FOREIGN PATENT DOCUMENTS 2082448 3/1982 United Kingdom ..... 15/41 R

*Primary Examiner*—Edward L. Roberts

*Attorney, Agent, or Firm*—John T. O'Halloran; Peter R. Ruzek; Mary C. Werner

[57] ABSTRACT

Height adjustment means for a cylindrical brush in a carpet sweeper with a U-shaped adjusting yoke which loads the cylindrical brush and is mounted in the housing by angled parts molded on the free ends of its members and is loaded at the summit part by a spring connected to an adjusting slide and riding up on ramp surfaces.

5 Claims, 4 Drawing Figures

HEIGHT ADJUSTMENT MEANS FOR A CYLINDRICAL BRUSH IN A CARPET SWEEPER

BACKGROUND OF THE INVENTION

The invention relates to a height adjustment means for a cylindrical brush in a carpet sweeper of the type including a housing, means for supporting the housing for movement on a surface to be cleaned and means for moving the housing.

A height adjustment means for the cylindrical brush is necessary in higher quality carpet sweepers in order to adjust the cylindrical brush optimally to the different pile heights of the carpets. In many cases it is also desired to clean totally smooth floors with a carpet sweeper.

A height adjustment means for the cylindrical brush of carpet sweepers is known from German Offenlegungsschrift No. 3,100,497. In this height adjustment means the cylindrical brush maintains a constant position relative to the housing, whereas the drive wheels are adjusted relative to the latter. This necessitates a highly complicated mounting of the drive wheels in a wheel box. This construction is suitable principally for large luxurious floor sweeping machines.

SUMMARY OF THE INVENTION

The aim of the invention is to produce a height adjustment means for a cylindrical brush which is of extremely compact construction, consists of a small number of individual parts, and is also suitable for small sweepers.

This aim is achieved by providing a cylindrical brush means and means for mounting the brush means on the housing for adjustment of the spacing thereof from the surface to be cleaned including an adjusting member having two free ends and holding said brush means in the housing for rotation about an axis, supporting parts each extending from one of the ends of the member at an angle relative thereto and being pivotally mounted in the housing, an adjusting element slidably mounted on the housing, means for pivoting the adjusting member about the supporting parts having two ends, each of which is slidably mounted on the member, and having a section between the ends which is connected to the adjusting member, and inclined portions on the interior surface of the housing for guiding the ends of the pivoting means during movement along the adjusting member.

For this height adjustment means, only an adjusting element and a spring are required besides the adjusting member. The assembly is ideally simple, because the parts are merely hooked in or clipped in; the inclined surfaces are molded directly on the housing or on a housing part. The unit is of extremely flat construction, which greatly contributes to the handiness of a sweeper. The sweeper can be made extremely flat overall.

The additional provision of guide surfaces and U-shaped eyes on the spring serve for additional operational reliability. The spring is reliably prevented from jumping out by this means.

Because the entire unit requires only a little space, it is particularly advantageous to make the housing part, which carries and influences this unit, exchangeable. This creates the possibility of establishing a constructional series of carpet sweepers. If it is required to simplify the sweeper, then the housing part with the unit and the U-shaped adjusting yoke are simply omitted and replaced by a cover enlarged by this part. All the other components of the carpet sweeper may be used identically. This makes it possible to manufacture large batches of the essential components on a low cost basis despite a wide variety of models.

BRIEF DESCRIPTION OF THE DRAWING

Above-mentioned and other features and objects of this invention will become more apparent by reference to the following description taken in conjunction with the accompanying drawings in which.

DESCRIPTION OF THE PREFERRED EMBODIMENT

Figure 1:
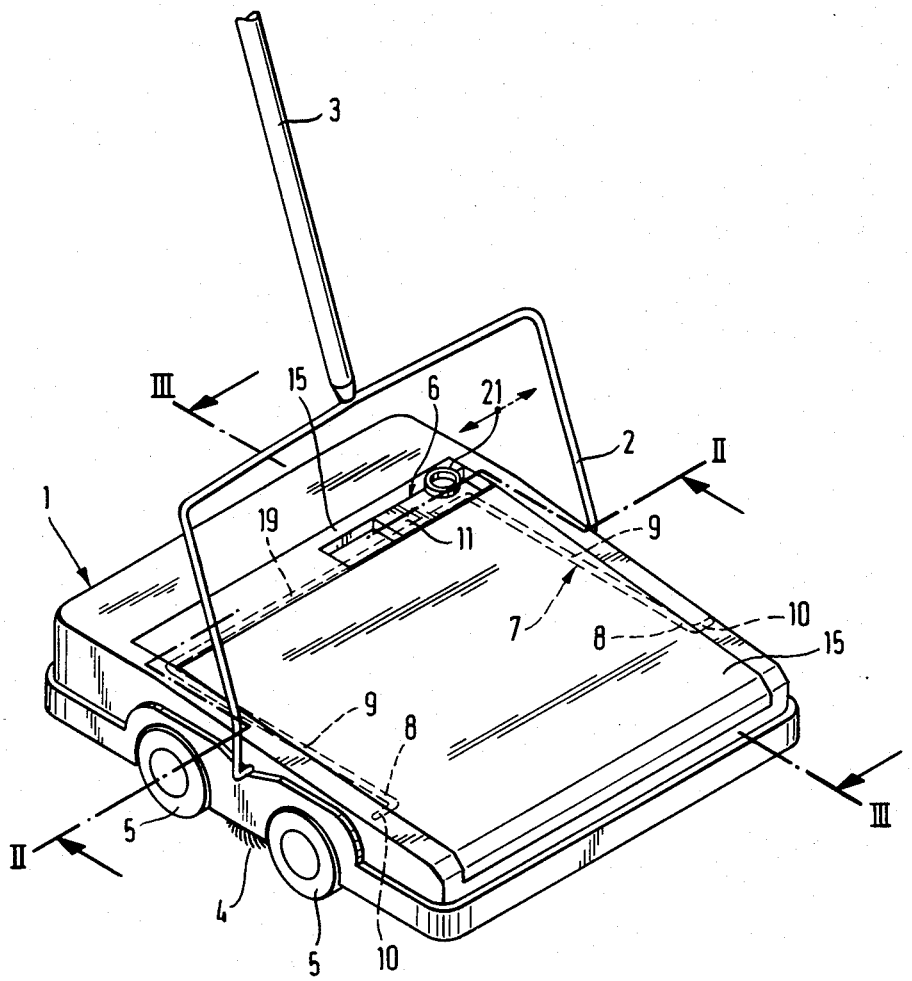
FIG. 1 illustrates a general view of the carpet sweeper of this invention with adjusting slide.

The carpet sweeper comprises, externally, substantially of a housing 1, a handle yoke 2 with handle 3, a cylindrical brush 4, drive/running wheels 5 and a height adjustment means 6. The further components of the carpet sweeper are irrelevant to the invention, and therefore will not be discussed further.

The height adjustment means is composed of a U-shaped adjusting yoke 7, which is mounted in the housing 1 by angle parts 10 molded on the free ends 8 of its members 9, an adjusting slide 11, a spring 12 connected to the latter and the ramp surfaces 13 on the housing 1. The cylindrical brush 4 is loaded by the members 9 of the adjusting yoke 7 with interposition of a brush bridge 14.

The adjusting slide 11 is mounted in a housing part 15 which is arranged exchangeably in the housing 1. The adjusting slide 11 is engaged by a mushroom-shaped cam 16 on the spring 12. The adjusting stroke of the adjusting slide 11 is dictated by a slit 17 in the housing part 15. The spring 12 is contructed as a leaf spring and is provided at each of its two ends with an eye 18 which surrounds in U-shaped configuration the summit part 19 of the adjusting yoke 7. Guide surfaces 20 which are molded on the eyes 18 slide on the ramp surfaces 13 on both sides.

Figure 2A:
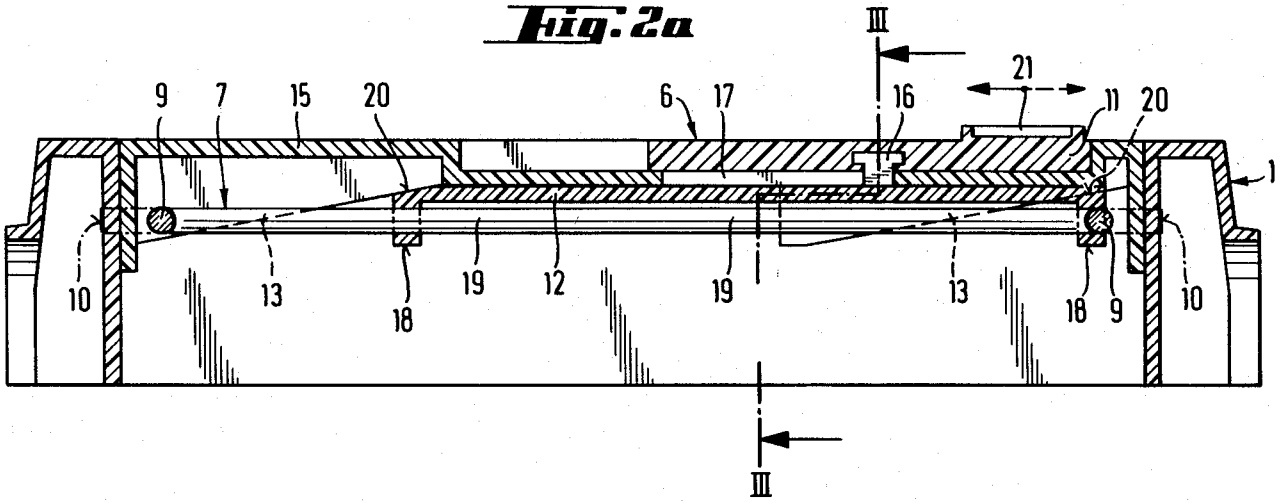
FIG. 2*a* shows a section taken along the line II—II of FIG. 1 in the top position of the cylindrical brush.
Figure 2B:
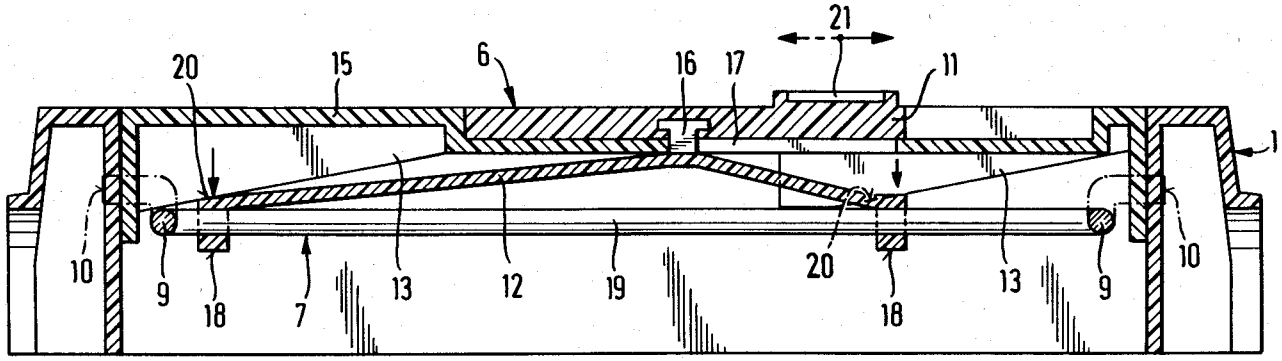
FIG. 2*b* shows also a section along the line II—II of FIG. 1 in the bottom position of the cylindrical brush.
Figure 3:
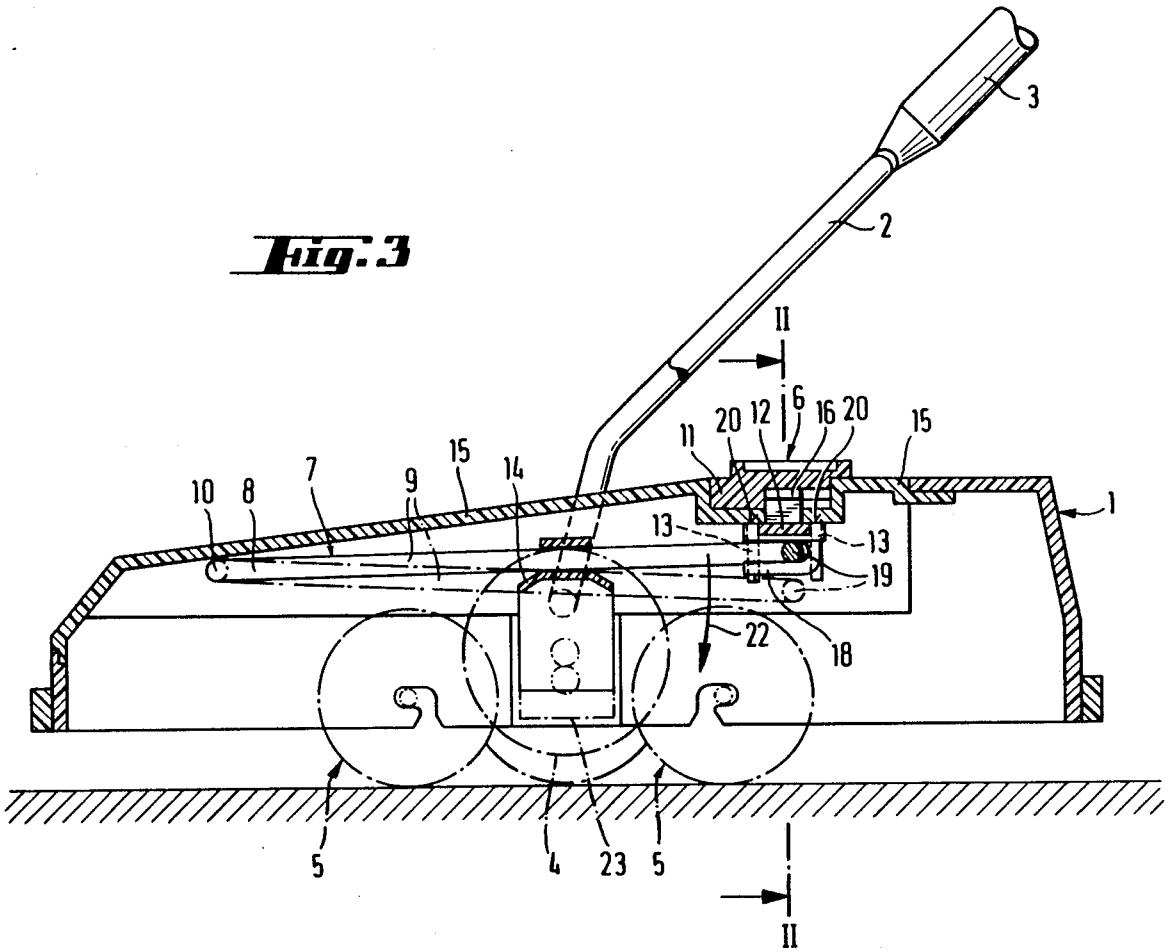
FIG. 3 shows a section along the line III—III of FIG. 2*a*.

By sliding the adjusting slide 11 in the direction 21 from the position according to FIG. 2*a*, the bottom position of the cylindrical brush 4 according to FIG. 2*b* is reached. The members 9 then execute an angular movement 22 and slide the brush bridge into the position 23 shown by chain-dotted lines in FIG. 4.

While we have described above the principles of our invention in connection with specific apparatus, it is to be clearly understood that this description is made only by way of example and not as a limitation to the scope of our invention as set forth in the accompanying claims.

We claim:

1. In a carpet sweeper of the type including a housing, means for supporting said housing for movement on a surface to be cleaned and means for moving said housing, the combination comprising:

cylindrical brush means; and means for mounting said brush means on the housing for adjustment of the spacing thereof from the surface to be cleaned including an adjusting member having two free ends and holding said cylindrical brush means in said housing for rotation about an axis, supporting parts each extending from one of said ends of said member at an angle relative thereto and being pivotally mounted in said housing, an adjusting element slidably mounted on said housing, means for pivoting said adjusting member about said supporting parts, said means having two ends, each of which is slidably mounted on said member, and a section between said ends which is connected to said adjusting element, inclined portions on the interior surface of said housing for guiding said ends of said pivoting means during movement along said adjusting member.

2. The carpet sweeper as claimed in claim 1 wherein said adjusting member is substantially U-shaped having two lateral sections and a transverse section joining said lateral sections, and wherein said brush means is mounted on said lateral sections and said ends of said pivoting means are mounted on said transverse section.

3. The carpet sweeper as claimed in claim 2 wherein said section of said pivoting means is a spring and said ends of said pivoting means are projections each of which at least partially surround said transverse section of said adjusting member.

4. The carpet sweeper as claimed in claim 3 wherein said projections are of U-shaped construction and include guide surfaces which engage with said transverse section of said adjusting member.

5. The carpet sweeper as claimed in claim 1 wherein said housing has one removable part which has said mounting means attached thereto.

* * * * *